United States Patent [19]

Harris, Jr. et al.

[11] 4,216,662

[45] Aug. 12, 1980

[54] CUSHION STITCH CONSTRUCTION FOR MEN'S HOSIERY

[75] Inventors: J. Nimrod Harris, Jr.; Willie M. Howell, both of Burlington, N.C.

[73] Assignee: Pickett Hosiery Mills, Inc., Burlington, N.C.

[21] Appl. No.: 883,327

[22] Filed: Mar. 3, 1978

[51] Int. Cl.[2] ..... A41B 11/02; D04B 9/46

[52] U.S. Cl. ..... 66/186; 66/202; 66/185

[58] Field of Search ..... 66/178, 178 A, 182, 66/183, 184, 185, 186, 187, 202, 170, 171, 169; 2/239

[56] References Cited

U.S. PATENT DOCUMENTS

| | | | |
|---|---|---|---|
| 882,951 | 3/1908 | Mettler | 66/182 |
| 1,123,924 | 1/1915 | Quinn | 66/200 |
| 1,330,818 | 2/1920 | Pigeon | 66/136 |
| 2,050,535 | 8/1936 | Martel | 66/185 X |
| 2,092,616 | 9/1937 | Ruckel | 66/185 X |
| 2,714,813 | 8/1955 | Hill | 66/185 |
| 3,015,943 | 1/1962 | Loizillon | 66/202 X |
| 3,107,510 | 10/1963 | Manger | 66/185 |
| 3,298,205 | 1/1967 | Reymes-Cole | 66/185 |
| 3,307,377 | 3/1967 | Imboden | 66/185 X |
| 3,828,585 | 8/1974 | Thorneburg | 66/136 |

FOREIGN PATENT DOCUMENTS

| | | | |
|---|---|---|---|
| 1194507 | 5/1959 | France | 66/185 |
| 848218 | 4/1960 | United Kingdom | 66/185 |
| 1034804 | 7/1962 | United Kingdom | 66/185 |
| 979297 | 1/1965 | United Kingdom | 66/138 |

OTHER PUBLICATIONS

Wignal, "Hoisery Technology", Nat. Ltd. Outxrn'r Assoc., N.Y. pp. 63–64.

*Primary Examiner*—Ronald Feldbaum

[57] ABSTRACT

A circular knit sock has a leg and upper foot portion knitted from a body yarn in a conventional stitch pattern, and a lower foot portion knitted from a combination of the body yarn and an auxiliary or reinforcement yarn of a second fiber content in a cushion stitch which has: (1) a first set of alternating courses knitted from the body yarn; (2) a second set of alternating courses knitted from a combination of the body and reinforcement yarns; (3) a first set of alternating wales formed of plain stich loops made from a combination of the body yarn and the auxiliary yarn; and (4) a second set of alternating wales formed of successive tuck stitches made from the combined auxiliary and body yarns of one course and the body yarn of the preceding or adjacent course.

8 Claims, 3 Drawing Figures

CUSHION STITCH CONSTRUCTION FOR MEN'S HOSIERY

BACKGROUND OF THE INVENTION

It is well known in the hosiery industry that circular knit socks constructed from nylon or other of the man-made fibers are long-wearing and resilient but lack the comfort characteristics and absorbency of socks made from cotton or wool. Related prior art teaches the use of combinations of man-made and natural products in sock and stocking construction to obtain the advantages of both types of fibers. There are examples of socks which have a portion of the lower foot constructed of combined yarns to obtain the warmth, absorbency and hand of cotton or wool and the durability of man-made or synthetic fibers such as nylon, while the upper foot and leg are constructed entirely of nylon or other synthetics for durability and resiliency or elasticity. These features are also found in ladies' stockings of finer denier yarns.

In the area of men's socks, however, the prior art which teach the use of combined yarns as described above often disclosed a finished article which is generally bulky and somewhat heavier than may be desired for dress wear. For instance, U.S. Pat. No. 3,307,379 to Woolley et al discloses a sock constructed primarily of nylon with a second, inner wall of a softer yarn; thereby creating a double-walled, relatively heavy sock. U.S. Pat. No. 2,800,782 to Bridges discloses the use of terry loops in a reinforced portion of the foot for comfort and warmth; again creating considerable bulk. Additionally, there are other U.S. patents disclosing a sole or lower foot portion having a double-layer of fabric for cushioning, and although there are other examples of cushion and/or reinforcement stitch structures in the foot portion which are somewhat similar to the present invention, none satisfactorily achieve the cushioning and other comfort characteristics of cotton or wool without a significant increase in bulk.

The increased bulk of socks in the prior art is not a serious disadvantage in casual wear or athletic socks. However, in dress wear such increased bulk can be extremely uncomfortable as some dress shoes are cut more closely and do not have the wearing ease and stretch of casual or athletic shoes.

Because of the difference in casual, athletic, and dress shoes, most dress socks are constructed from finer denier yarns in a closely knit stitch which decreases bulk as much as possible. Consequently, comfort features such as cushioning, absorbency and warmth are sacrificed to achieve close fit.

SUMMARY OF THE PRESENT INVENTION

The present invention then is directed to a unique, relatively non-bulky construction which has a portion of the foot knitted from a combination of nylon or other long wearing, resilient yarn and an auxiliary reinforcing cotton or wool yarn imparting the characteristics of absorbency, softness, and warmth.

According to the teachings of the present invention a sock, particularly a man's dress sock, has a leg and upper foot portion knitted in a conventional stitch from a body yarn, preferably nylon, having stretch, durability and longwearing characteristics. The lower foot portion or sole of the sock is knitted in a cushion stitch from a combination of the body yarn and an auxiliary, reinforcement yarn of cotton, wool or other fiber having the same characteristics of absorbency and softness and warmth. The heel and toe portions may be knitted from the body yarn along or, from a combination of the body and auxiliary yarns, but is preferably knitted from the auxiliary yarn alone for maximum comfort.

The aforementioned cushion stitch utilized in the lower foot or sole of the sock is the key to obtaining the desired wear characteristics of comfort and absorbency while avoiding a significant increase in bulk.

This unique cushion stitch which is utilized in at least the sole portion of the sock, but may also be used in the toe and/or heel, is defined by: alternating courses wherein a first set are knitted from a combination of the body yarn and the auxiliary yarn with intervening sets of courses which are knitted from the body yarn alone; and, alternating wales wherein in a first set of wales plain stitch loops are formed from the combined body and auxiliary yarns with intervening plain stitch loops formed of body yarn alone, and a second set of alternating wales made of tuck loops or stitches in which the lone body yarn is in the same loop or stitch with the combined body and auxiliary yarns.

Fabric knitted in alternating wales formed of tuck loops according to the above description gives the appearance of having the auxiliary or reinforcing yarn in each wale of each course when in fact it is only present in alternate wales of each course. This unique tucking pattern provides desired reinforcement, absorbency and cushioning characteristics without a significant increase in actual bulk and weight because the reinforcement yarn is introduced only in alternate courses.

In a second embodiment the combined body and auxiliary yarns are floated across the aforementioned first set of wales, alternating with the wales which include the tuck stitches. While these floats create a somewhat bulkier sock than that of the preferred embodiment, it is less bulky than those in the known prior art and provides a quite satisfactory dress sock. In the instance where more absorbency and cushioning are desired to float stitches may constitute the preferred stitch.

The objects of the present invention include:

1. The provision of a man's dress sock which has a reinforced, cushioned sole with minimal bulk; and 2. The provision of a sock having in the sole portion the performance characteristics of nylon combined with the comfort of wool or cotton in a close fitting, non-bulky construction.

Other objects and advantages of the present invention will become apparent to those skilled in the art as the following detailed description is studied in conjunction with the accompanying drawings of which:

DETAILED DESCRIPTION OF A PREFERRED EMBODIMENT

Figure 1:
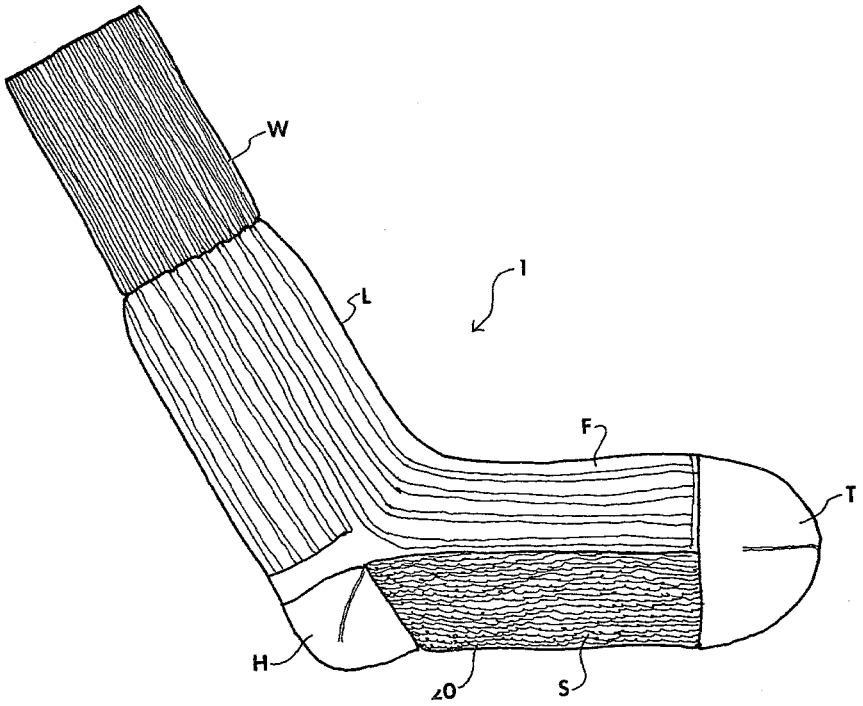
FIG. 1 is a perspective side view of a sock constructed according to a preferred method of the present invention.

FIG. 1 illustrates a sock 10 having a sole portion S constructed in accordance with the present invention. The sock 10 includes a leg portion L having an upper rib or welt portion W, a heel H, a toe T, an upper foot F, and a lower foot portion or sole S formed with a cushion stitch 20 to be described hereinbelow.

The sock 10 is constructed on a conventional circular knitting machine with at least two feeds, which machine is not described herein as it is well known. For necessary descriptive purposes the machine will be discussed as having a first and second feed stations, but sock construction is not limited to only two feeds.

The welt W and leg L portions of the sock 10 are formed in a conventional manner on the knitting machine from a body yarn B picked up at each of the two feeds. The stitch utilized in the welt W and leg L portions is a matter of choice including any of the known stitches such as plain, rib, etc.

When the leg portions are completed to the desired length the heel H is reciprocatorily formed preferably from an auxiliary or reinforcing yarn R picked up at one or both feeds in a known manner.

When the heel H is completed, the upper and lower foot portions F,S are formed in continuous courses divided into a first semi-circular portion wherein the upper foot F is knitted from body yarn B taken at each feed and utilizing the same stitch as used in the leg portion L. The lower foot/sole S is knitted from a combination of body yarn B from each feed and reinforcing yarn R from one of the feeds in a cushion stitch that will be fully described below.

Following completion of portions F and S the toe portion T is formed from reinforcing yarn R and closed in a conventional manner.

As described hereinabove, the unique cushion construction of the sole portion S, along with the preferred formation of the remaining foot portions is the point of invention providing a reinforced, cushioned sole sock with minimal bulk. Also as previously described it is preferred that body yarn B be of a nylon fiber of a denier normally used for men's hosiery, and that the auxiliary or reinforcing yarn R be of a natural fiber such as cotton or wool in a weight or denier compatible with the chosen body yarn. The choice between cotton or wool for the auxiliary yarn is generally determined by the absorbency, strength, warmth or hand characteristics desired in a particular sock.

Figure 3:
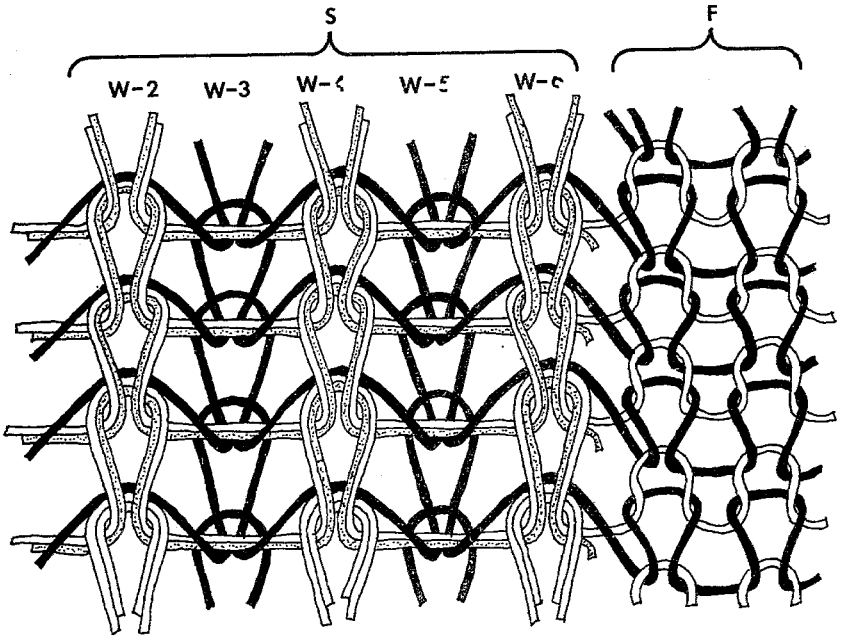
FIG. 3 is a stitch diagram of an alternate construction of the sole area S of the sock in FIG. 1.
Figure 2:
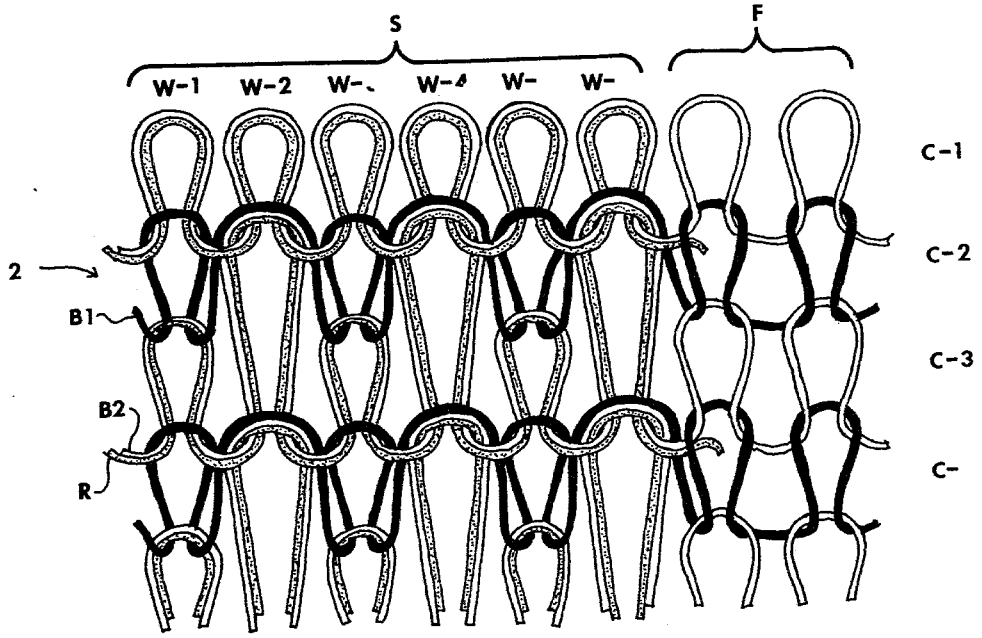
FIG. 2 is a stitch diagram of the preferred construction of the sole area S of the sock in FIG. 1.

FIGS. 2 and 3 illustrate a preferred stitch pattern 20 and an alternate stitch pattern 30, respectively, for the cushion stitch utilized in the sole portion S of the sock. Stitch diagrams for the toe T and heel H portions are not provided because a plain knit stitch formed from the auxiliary yarn R is preferred and the construction technique is well known. Alternatively the cushion stitch as described hereinbelow may be used in the heel and toe although to do so will increase the bulkiness of those portions of the sock. However, it is preferred the auxiliary yarn R be utilized rather than nylon to form the heel and toe portions for comfort due to the absorbency and softness of the selective wool or cotton fiber.

As mentioned above, the heel H is knitted in a reciprocating motion of the cylinder, and when the heel is completed the upper portion F and the lower sole S are alternately knitted during continuous rotary motion as segments or half-courses. The upper portion F is formed in half courses of the body yarn B in the same stitch used in the leg portion L. During knitting of the sole portion S, the reinforcing yarn R is spliced in and formed according to the knit structure described hereinafter.

Referring to the preferred cushion stitch construction 20 diagrammed in FIG. 2, it is shown that the pattern includes alternating wales W-1, W-3, W-5, of plain stitches throughout, while intervening wales W-2, W-4, W-6 include tuck stitches throughout in which a loop from one course is retained on the needles as the needles lower and is then cast off with the loops of the succeeding course. Alternating courses C-1, C-3 are fed with the combination of body yarn B-2 and reinforcing yarn R, while intervening courses C-2, C-4 are formed of body yarn B-1 alone.

In the sole S, cushion stitch 20 (which is a considerably larger area than that illustrated in FIG. 2, since the drawing figure is for illustrative purposes only), is knitted by continuous rotation of the needle cylinder. Alternating wales (W-2, W-4, W-6) being formed of tuck stitches wherein the combined yarns B-2, R, or the body yarn B-1 are picked up at one feed, retained on the needles, and not cast off until the succeeding feed with the other of the yarns. As can be seen in FIG. 2, this unique tucking pattern and the resultant elongated loops in wales W-2, W-4, W-6, gives the appearance that the reinforcing yarn R is present in each course when in actuality it is only fed in alternating courses C-1 and C-3.

It is preferred that the sock 10 be knitted on a two-feed circular knitting machine of the type having yarn feeding fingers at each of the stations and cams, jacks, or other needle control devices determining which needles are raised at each feed to selectively pick up either the body yarn B-1 alone, the body yarn B-2 and the reinforcing yarn R combined or the reinforcing yarn R (heel and toe). However, it should be understood that the sock as disclosed may be made on a double cylinder machine, a four-feed machine, or other combinations though none of these need be described herein. Further, the fabric may contain stitches with all loops on the same side, as illustrated, or the stitches in alternate wales may be formed on the opposite side or "purled".

When the sock is knitted on a two-feed machine body yarn R is fed to the needle at each station to knit the leg portions W and L. To knit the heel area H, in a preferred embodiment reinforcing yarn R alone is fed to the needles at the first feeding station, with the machine in a reciprocating motion, knitting and casting off in a plain stitch in each wale. During the formation of the sole S and the upper foot F, and assuming there are (for example only) 110 needles in the cylinder the process will be as follows:

The needles forming wales W-1, W-3, and alternately through W-55 cast on body yarn B-2 combined with reinforcement yarn R at first feed station and body yarn B-1 alone at the second feed station, to form plain stitch loops with the yarns from both feeds throughout the wale. The needles forming wales W-2, W-4 and alternately through W-54 will, at the first feed station cast on combined yarns B-2 and R and hold thereon until yarn B-1 is cast on at the second feed station to form tuck stitches continuously throughout those wales. Needles forming wales 56 through 110 (not shown) cast body yarns B-1 and B-2 on and off at each station in a selective stitch pattern to form the upper foot F, it being understood that reinforcing yarn R is only introduced during the half course in which needles forming wales 1-55 are activated.

Thereby, alternate courses C-2, C-4 etc. will be formed of body yarn B-1 and whereas wales W-1, W-3, etc. will have one stitch per course, wales W-2, W-4 etc. will have one stitch per two courses because the needles forming those wales will cast off only at alternate feed stations. Further and importantly, the reinforcing yarn R, which is initially introduced in courses C-2, C-4, etc., will appear in the fabric in courses C-2, C-4, etc. at wales W-1, W-3, W-5, etc., however, will appear in courses C-1, C-3, C-5, etc. in wales W-2, W-4, etc. Thus the desired characteristics of the reinforcing yarn will appear in each course, although only introduced in alternate courses.

FIG. 3 illustrates the pattern for an alternative approach to the cushion stitch which is somewhat weaker than that of FIG. 2, but less bulky than the structure of FIG. 2 and still strong enough to be satisfactory. Again considering a two-feed circular machine, the cushion stitch 30 is constructed as follows:

Just as in cushion stitch 20, the needles forming wales W-2, W-4 form tuck stitches of yarns B-1 and the combined yarns B-2, R. However, in wales W-3, W-5 etc., at the feed station for yarn combination B-2, R, the needles are deactivated and do not cast on the yarn B-2, R, thereby forming miss stitches of the combined yarns. In other words, the combined yarns B-2, R are floated across the back of the fabric in wales W-3, W-5 etc. These floats in alternate wales comprise the only difference in the construction of cushion stitches 20 and 30.

After the sole S and upper foot F courses are completed the toe T is knit in plain or other selective stitch from body yarn B-1 and/or B-2 alone and closed according to any of several known methods. As mentioned earlier the toe T and heel H preferably are knitted only of the cotton or wool reinforcing yarn, however, the heel and toe may also be formed by the unique cushion stretch of the present invention.

Regardless of the area of use of the reinforcing yarn R, it should be spliced in by any suitable cutting or splicing mechanism, closely adjacent the underside of the fabric, at the splice point between the appropriate courses and wales.

Other modifications may be made to the above described method and article of manufacture without departing from the scope of the invention which is limited only by the following claims.

What is claimed is:

1. A knitted seamless men's hose having leg, heel, toe, upper foot and sole portions with at least said sole portion being constructed as to include a cushion knit stitch comprising:

(a) a first set of courses being formed of stitch loops of a combination of a body yarn made from a first type of fiber and a reinforcement yarn made from a second type of fiber;

(b) a set of intervening courses being formed of stitch loops of said body yarn alone;

(c) a set of alternating wales formed of plain stitch loops formed of said body yarn alone separated by intervening stitches formed of a combination of said body yarn and said reinforcement yarn;

(d) a second set of alternating wales formed of tuck stitch loops including both said body yarn alone and said combination of body and reinforcing yarns.

2. The seamless men's hose according to claim 1 wherein said first type of fiber is that having characteristics of long wear and resiliency and wherein said second type of fiber is that having characteristics of strength and absorbency.

3. The seamless men's hose according to claim 2 wherein said first type of fiber is nylon and said second type of fiber is cotton.

4. A method of constructing a cushion stitch in the foot portion of a seamless knitted sock having a leg, heel, toe, upper foot and sole portions on a multifeed hosiery machine, said method comprising the steps of:

(a) introducing a body yarn and a reinforcing yarn during a portion of the needle cylinder rotation at a first feed to form a first set of alternating segmented courses;

(b) introducing a body yarn alone during said portion of needle cylinder rotation at a second feed to form a second set of alternating segmented courses;

(c) during said portion of needle cylinder rotation activating a first set of alternating needles at each feed to form a first set of alternating wales having a series of successive plain stitch loops;

(d) during said same portion of needle cylinder rotation, activating a second set of alternating needles to cast on but not off the yarn combination from said first feed, then casting on and off the body yarn from said second feed along with the retained loops from the preceding course to form a second set of alternating wales having a series of successive tuck stitches.

5. A method of constructing a seamless knitted sock as described in claim 4 wherein during step (c) the first set of needles are not lifted high enough at said first feed to engage the combination body and reinforcing yarns, and thus the combination of body and reinforcing yarn is floated across said first set of alternating wales.

6. In a men's hose having a leg, heel, toe, upper foot, and sole portion, a unique cushion construction for at least said sole portion, said cushion construction comprising:

(a) a first set of courses formed of a body yarn of a first type of fiber;

(b) a set of intervening courses formed by introducing therein a combination of a body yarn of said first type and a reinforcing yarn of a second type of fiber;

(c) said reinforcing yarn knitted into said cushion construction in said intervening set of courses in a first set of alternating wales and in said first set of courses in a second set of alternating wales.

7. A seamless men's hose as described in claim 1 wherein said intervening stitches comprise plain stitch loops formed of said combination of said body yarn and said reinforcement yarn.

8. A seamless men's hose as described in claim 6 wherein said intervening stitches comprise float stitches formed of said combination of said body yarn and said reinforcement yarn.

* * * * *